US005159832A

United States Patent [19]

White

[11] Patent Number: 5,159,832

[45] Date of Patent: Nov. 3, 1992

[54] INDICATING DEVICE

[75] Inventor: Wade White, Carlsbad, N. Mex.

[73] Assignee: Wada Ventures, Hobbs, N. Mex.

[21] Appl. No.: 826,687

[22] Filed: Jan. 29, 1992

Related U.S. Application Data

[63] Continuation of Ser. No. 618,954, Nov. 28, 1990, abandoned.

[51] Int. Cl.[5] ..... E21B 47/00

[52] U.S. Cl. ..... 73/151; 340/665

[58] Field of Search ..... 73/119 A, 151; 340/665, 340/686; 116/202, 230, 212

[56] References Cited

U.S. PATENT DOCUMENTS

| | | | |
|---|---|---|---|
| 2,696,111 | 2/1951 | Connor . | |
| 2,703,008 | 8/1951 | Seljos et al. . | |
| 3,339,462 | 6/1965 | Bankowski . | |
| 3,343,409 | 10/1966 | Gibbs . | |
| 3,875,792 | 4/1975 | Krohn et al. | 73/119 A |
| 3,942,366 | 3/1976 | Hofmann | 73/119 A |
| 4,181,010 | 1/1980 | Knape et al. | 73/119 A |
| 4,194,393 | 3/1980 | Boley | 73/151 |
| 4,286,925 | 9/1981 | Standish | 417/12 |
| 4,363,605 | 12/1982 | Mills | 417/44 |
| 4,417,236 | 11/1983 | Hung | 340/626 |
| 4,509,901 | 4/1985 | McTamaney et al. | 417/18 |
| 4,779,690 | 10/1988 | Woodman | 177/208 |

*Primary Examiner*—Robert Raevis

*Attorney, Agent, or Firm*—Burns, Doane, Swecker & Mathis

[57] ABSTRACT

An indicating device for repeatedly indicating variation in the load on a part such as a polish rod of a pump is disclosed. The indicating device includes an indicator for providing an indication when current flows through the indicator, a switch for moving between an opened and a closed position and for permitting current to flow through the indicator when the switch is in one of the open and closed positions, and reciprocating moving means for reciprocally moving in response to reciprocating movement of the part and for moving the switch to the one of the open and closed positions once during each cycle of the reciprocating movement of the reciprocating moving means. The indicator thus provides the indication once during each cycle of the reciprocating movement of the part and thus repeatedly indicates reciprocating movement of the part.

22 Claims, 1 Drawing Sheet

INDICATING DEVICE

This application is a continuation of application Ser. No. 07/618,954, filed Nov. 28, 1990, now abandoned.

FIELD OF THE INVENTION

The present invention relates to devices useful for indicating variations in load on reciprocally moving parts. More particularly, the present invention relates to indicating devices for indicating variations in polish rod loads.

BACKGROUND AND SUMMARY OF THE INVENTION

Several types of devices which are adapted to provide indications of the performance of reciprocally moving parts are known in the prior art. For example, U.S. Pat. No. 4,509,901 to McTamaney et al. discloses an apparatus for detecting problems in sucker-rod well pumps, which includes a first transducer which is located between an upper end of a sucker-rod string and a lower end of a cable section. U.S. Pat. No. 3,343,409 to Gibbs discloses a method of determining sucker rod performance in which a strain-gauge load cell is connected to a polished rod to measure the polished rod load. Also, U.S. Pat. No. 4,363,605 to Mills discloses an apparatus which generates an electrical signal which is proportional to the tension in a bridle which supports a string of a sucker rod. The apparatus includes a load cell between two arms which are attached to two bridle cables and which place the load cell in compression, so that the load cell generates an electrical signal proportional to the force needed to spring the cables apart from each other. The apparatuses of the above-mentioned patents each have the disadvantage, however, that they involve relatively complex electrical measurement and/or computation, and thus tend to be relatively complex and expensive to manufacture.

Other devices are known in the prior art which provide continuous indications of a weight on a drill bit. For example, U.S. Pat. No. 2,703,008 to Seljos et al. discloses a weight-on-bit indicating apparatus which includes a weight responsive device attached to a line of a well drilling rig. The weight responsive device generates a pressure signal to three diaphragms which are pressure-balanced such that the weight on a bit of the well drilling rig registers on a gauge. Also, U.S. Pat. No. 2,696,111 to Conner discloses a drill string weight indicating apparatus which includes a roller to which force is applied by a drill string, a diaphragm which is connected to the roller and which closes a chamber, and a pressure gauge connected to the chamber to indicate the load on the drill string based on the pressure in the chamber. These devices have the disadvantage, however, that they are designed for use with a drill string which moves slowly past the devices in one direction only. Thus these devices are of little use in providing an indication of the variation in load on a reciprocally moving part.

One device is known in the prior art which provides an indication of the pressure in an apparatus, wherein the apparatus includes a reciprocatingly moving part. U.S. Pat. No. 4,417,236 to Huno discloses an overload detecting device for a hydraulic jack which includes a pressure sensitive switch member having a piston-like member in a housing. The piston-like member communicates with a duct of the hydraulic jack and is biased in one direction by a spring. If the pressure in the duct rises above a predetermined value, the pressure overcomes the bias of the spring, and the piston-like member contacts a spring plate to set off an alarm. One of the disadvantages of this device, however, is that the device only actuates the alarm when the pressure in the hydraulic jack rises above a certain level. Thus, this device is of little use in providing a repeated indication of reciprocating movement of a part such as a polish rod.

In view of the above, it is an object of the present invention to provide an improved device for indicating variations in load on a reciprocally moving part such as a polish rod.

A further object of the present invention is to provide an indicating device which is relatively simple and inexpensive to manufacture.

It is a further object of the present invention to provide a simple, reliable device which will provide an indication of load variation once during each cycle of the reciprocally moving part.

It is a further object of the present invention to provide an indicating device which requires relatively minimal technical sophistication to monitor.

Yet another object of the present invention is to provide an indicating device which is subjected to the full load on a reciprocating moving part to more accurately monitor the moving part.

It is a further object of the present invention to provide an indicating device which provides continuous monitoring of a reciprocally moving part.

It is a further object of the present invention to provide an indicating device which is of rugged construction and thus resistant to damage.

It is a further object of the present invention to provide an indicating device which is simple to repair when necessary.

A further object of the present invention is to provide an indicating device which is adjustable to compensate for wear on the device and for variations in a reciprocating movement of a part.

The above objects as well as other objects not specifically enumerated are accomplished by an indicating device for indicating variations in a load on a reciprocally moving part in accordance with the present invention. The indicating device of the present invention includes reciprocating moving means for reciprocatingly moving in response to the variations in the load, indicating means for providing an indication, and switch means for switching between an open state and a closed state and for causing current to flow through the indicating means when the switch means is in one of the open and closed states, wherein the reciprocating moving means causes the switch means to switch to the one of the open and closed states once during each cycle of the reciprocating movement of the reciprocating moving means.

The objects of the present invention are also accomplished by a polish rod load indicating device which includes a master piston and cylinder enclosing a fluid therebetween, wherein the master piston and cylinder are connectable to the polish rod such that one of the master piston and cylinder moves cyclically with respect to the other of the master piston and cylinder, a slave piston and cylinder enclosing a fluid therebetween which is in communication with the fluid enclosed by the master piston and cylinder, wherein the cyclical movement of the one of the master piston and cylinder produces a cyclically varying pressure in the fluids and wherein the cyclically varying pressure in the fluids causes one of the slave piston and cylinder to move cyclically relative to the other of the slave piston and cylinder, an indicator, and a switch, wherein the indicator produces a polish rod load indication signal in response to operation of the switch, and wherein the cyclically moving one of the slave piston and cylinder operates the switch to cause the indicator to produce the polish rod load indication signal once during each cycle of the cyclical movement of the cyclically moving one of the slave piston and cylinder.

The objects of the present invention are further accomplished by a polish rod load indicating device for indicating variation in a polish rod load, which includes a toroidally-shaped master piston, a toroidally-shaped master cylinder cooperating with the master piston to enclose a fluid, the master piston and cylinder being connected to a portion of the pump, a slave piston and cylinder enclosing a fluid which is in fluid communication with the fluid enclosed by the master piston and cylinder, wherein the slave piston includes a flange portion, is movable between extended and retracted positions within the slave cylinder, and is spring biased towards the retracted position, a switch, wherein the switch is movable between an open position and a closed position and is spring biased towards the open position, and an indicator, the indicator producing an indication when current flows therethrough, wherein the master piston is cyclically moveable in response to cyclical movement of the polish rod to produce a cyclically varying pressure in the fluids, and wherein the cyclically varying pressure causes the slave piston to move cyclically between the extended and retracted positions such that the flange portion of the slave piston moves the switch to the closed position when the slave piston is in the retracted position, closing of the switch causing current to flow through the indicator so that the indicator provides the indication once during each cycle of the cyclical movement of the master piston to indicate variation in the polish rod load.

BRIEF DESCRIPTION OF THE DRAWINGS

The preferred embodiments of the present invention will be described in greater detail with reference to the accompanying drawings, wherein like members bear like reference numerals and wherein.

DETAILED DESCRIPTION OF THE PREFERRED EMBODIMENT

Figures 1, 2:
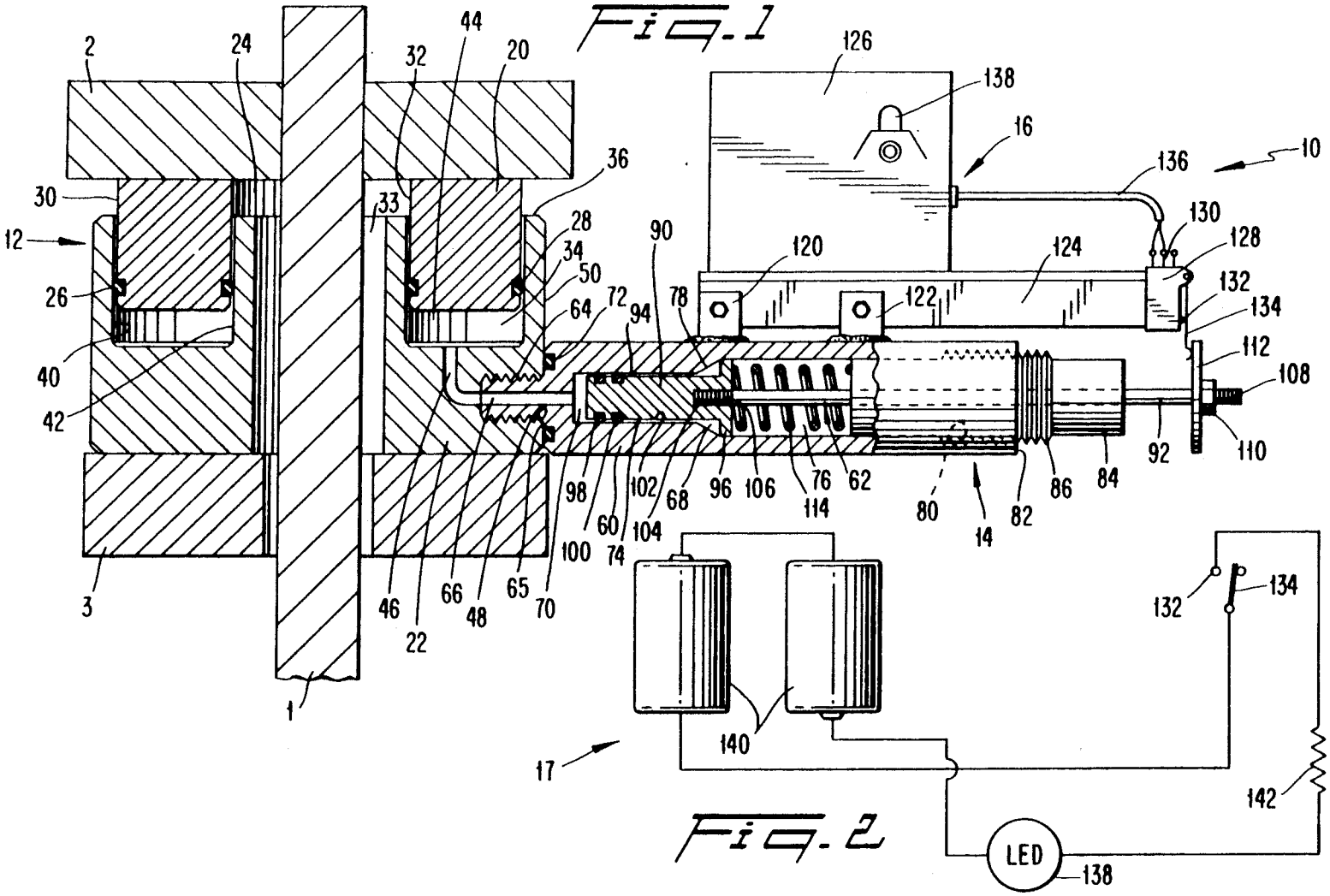
FIG. 1 is a partially cutaway side view of the indicating device of the present invention.
FIG. 2 is a diagram of an electrical circuit of the indicating device of FIG. 1.

With reference to FIGS. 1 and 2, an indicating device 10 in accordance with the present invention includes a master piston and cylinder arrangement 12, a slave piston and cylinder arrangement 14, and an indicating circuit arrangement 16 which includes an indicating circuit 17, as is explained further hereinbelow.

As is seen in FIG. 1, the master piston and cylinder arrangement 12 includes a master piston 20 and a master cylinder 22. The master piston 20 and the master cylinder 22 are shaped as right cylindrical toroids, and are especially adapted to extend around a polish rod 1 of a conventional pump between a polish rod clamp 2 and a bridle 3 of the pump, since the master piston 20 has a hole 24 therethrough and the master cylinder 22 has a hole 33 therethrough through which the polish rod 1 extends. The polish rod 1, as can be seen in FIG. 1, is tightly clamped by the polish rod clamp 2, and the polish rod clamp 2 rests on the master piston 20. The bridle 3 is pulled upwardly by portions of the pump which are not shown, and the master cylinder 22 rests on the bridle 3. Accordingly, as the bridle 3 is pulled upwardly, it also pulls the master cylinder 22, the master piston 20, the polish rod clamp 2, and the polish rod 1 upwardly, so that the master piston and cylinder bear the entire load on the polish rod 1.

The master piston 20 includes a pair of O-rings 26,28 which extend along outer and inner surfaces 30,32 of the master piston 20, respectively, and whose function will be described hereinbelow. The master cylinder 22 is larger than the master piston 20, and includes a right cylindrical, toroidally-shaped chamber 34 which extends downwardly therein from an upper surface 36 of the master cylinder 22. The chamber 34 is formed such that it is slightly larger than the master piston 20, so that the master piston 20 is slidably received in the chamber 34 with the O-rings 26,28 providing sealing contact between the master piston 20 and outer and inner walls 40,42, respectively, of the chamber 34.

Accordingly, the master piston 20 and the master cylinder 22 together enclose a fluid-tight space 44 which is formed from a lower portion of the chamber 34 and which is normally filled with a fluid. In addition, the master cylinder 22 includes a passageway 46 which communicates the space 44 with a threaded opening 48 in an outer surface 50 of the master cylinder 22.

As is seen in FIG. 1, the slave piston and cylinder arrangement 14 includes a slave cylinder 60 and a slave piston 62. The slave cylinder 60 is formed as an elongated, hollow cylinder which is open at both ends, and includes a threaded extension 64 extending from a first end 65 thereof. The threaded extension 64 is threadably engaged with the threaded opening 48 in the master cylinder 22, and a passageway 66 is formed through the threaded extension 64 such that it communicates the passageway 46 with a space 70 in a chamber 68 in the slave cylinder 60. The slave cylinder 60 also includes an 0-ring 72 which is fitted on the first end 65 of the slave cylinder 60 to prevent fluid leakage between the master cylinder 22 and the slave cylinder 60.

The chamber 68 of the slave cylinder 60 includes a first chamber portion 74 which has a smaller diameter, and a second chamber portion 76 which has a larger diameter. As can be seen from FIG. 1, a wall 78 is formed in a transition portion of the chamber 68 between the first and second chamber portions 74,76, and the space 70 in the chamber 68 is formed by a portion of the first, smaller diameter chamber portion 74. The second, larger diameter chamber portion 76 includes an internally threaded portion 80 which opens through a second end 82 of the slave cylinder 60 which is opposite the first end 65, and an elongated, hollow cylindrical plug 84 having external threads 86 thereon is threaded into the internally threaded portion 80 of the slave cylinder 60. The function and purpose of the plug 84 will be explained hereinbelow.

The slave piston 62 is an elongated member which fits slidably within the slave cylinder 60, and it includes a piston member 90 and an elongated rod 92. The piston member 90 includes a first portion 94 which has a diameter which is slightly smaller than the diameter of the first chamber portion 74 of the slave cylinder 60, and a second portion 96 which has a diameter which is slightly smaller than the diameter of the second chamber portion 76 of the slave cylinder 60, but which is larger than the diameter of the first chamber portion 74. The piston member 90 also includes sealing means therearound to prevent leakage from the slave piston and cylinder arrangement. For illustration purposes, the sealing means is shown as a pair of O-rings 98,100 which are fitted around an outer surface 102 of the piston member 90, but other sealing means such as a cup-type packing could just as easily be used. Accordingly, the first portion 94 of the piston member 90 fits slidably and fluid-tightly within the first chamber portion 74 of the slave cylinder 60 such that the piston member 90 and the slave cylinder 60 form the fluid-tight space 70, and the second portion 96 of the piston member 90 fits slidably within the second chamber portion 76 of the slave cylinder 60. Enclosed in the space 70 is a fluid which is in fluid communication with the fluid enclosed by the master piston 20 and the master cylinder 22.

The piston member 90 also includes a threaded hole 104 which extends through the second portion 96 of the piston member 90, and the elongated rod 92 is attached to the piston member 90 by threaded engagement of a first threaded end 106 of the elongated rod 92 with the threaded hole 104. As is shown in FIG. 1, the elongated rod 92 extends away from the piston member 90 through a hole in the plug 84 to a location outside the slave cylinder 60, and includes a second threaded end 108 onto which a threaded adjustment member 110 having a flange portion 112 is threaded. Also, a spring 114 is arranged in compression inside the second chamber portion 76 of the slave cylinder 60 between the plug 84 and the second portion 96 of the piston member 90, such that the slave piston 62 is spring biased toward the left in FIG. 1.

As is seen from FIG. 1, the indicating circuit arrangement 16 of the present invention includes a pair of mounts 120,122 which are welded to the outside of the slave cylinder 60, and which support a frame member 124 and thereby a circuit box 126. On one end of the frame member 124 is mounted a switch box 128 which includes a set of first terminals 130, a second terminal 132, and a switch member 134 which is pivotally mounted to the switch box 128 and which is spring biased away from the second terminal 132. The switch member 134 and the second terminal 132 together form a contact switch. A wire 136 is connected to two of the first terminals 130, which wire runs into the circuit box 126. On the outside of the circuit box 126 is mounted an LED indicator 138.

As is seen in FIG. 2, the second terminal 132, the switch member 134, and the LED indicator 138 all form part of an indicating circuit 17 of the present invention. As shown, the indicating circuit 17 is a simple circuit powered by two batteries 140 arranged in series, and includes a resistance 142 and the LED indicator 138 arranged in series. As is shown in FIG. 2, no current can flow through the indicating circuit 17 when the contact switch formed by the second terminal 132 and the switch member 134 is open. However, current will flow through the indicating circuit 17 and thus the LED indicator 138 will light when the contact switch is closed, i.e., when the switch member 134 contacts the second terminal 132 as shown in FIG. 1

With reference to FIGS. 1 and 2, the operation of the indicating device 10 will now be explained. In use, the master piston 20 and the master cylinder 22 are held between the polish rod clamp 2 and the bridle 3 of a conventional well pump. The bridle 3 moves reciprocally in an up and down manner to pull up the polish rod clamp 2, and thereby the polish rod 1, and then lower it repeatedly, and a cyclically varying force is thus applied to the master piston and cylinder arrangement which causes the master piston 20 to move reciprocally or cyclically with respect to the master cylinder 22. For example, with a pump stroke of approximately 64 inches, a force of about 20,000 lbs. is applied to the master piston and cylinder arrangement during an upstroke of the pump, while a force of only about 12,000 lbs. is applied to the master piston and cylinder during a downstroke of the pump.

Since the slave piston 62 and the slave cylinder 60 enclose in the space 70 a fluid which is in fluid communication with the fluid enclosed by the master piston 20 and the master cylinder 22, a cyclically varying pressure is produced in both of the fluids as the master piston 20 moves reciprocally or cyclically relative to the master cylinder 22. Thus, the cyclically varying pressure in the fluids acts to cause the slave piston 62 to move reciprocally or cyclically against the force of the spring 114, due to the force exerted on the piston member 90 by the fluids. The slave piston 62 therefore moves repeatedly between a retracted position wherein the second portion 96 of the piston member 90 is at its leftmost position in the chamber 68 as shown in FIG. 1 due to the force of the spring 114 acting between the plug 84 and the second portion 96, and an extended position wherein the second portion 96 of the piston member 90 is at its rightmost position in the chamber 68 due to the force of the fluids enclosed by the master and slave piston and cylinder arrangements.

As the slave piston 62 moves cyclically or reciprocally, the threaded adjustment member 110 moves rigidly with the slave piston 62, and thus the flange portion 112 of the threaded adjustment member 110 moves cyclically left-to-right and right-to-left in FIG. 1. The flange portion 112 of the threaded adjustment member 110 thus repeatedly moves the switch member 134 from a spring biased open position to a closed position seen in FIG. 1 where the switch member 134 contacts the second terminal 132, and then releases the switch member 134 to allow it to return to its spring biased open position. Thus, each time the slave piston 62 is brought into its retracted position, the contact switch of indicating circuit 17 is closed, and current flows through the indicating circuit 17 to light the LED indicator 138.

As can be appreciated from FIG. 1, turning of the plug 84 relative to the slave cylinder 60 will result in axial movement of the plug 84 relative to the slave cylinder 60, due to the coaction of internally threaded portion 80 and external threads 86. Accordingly, the force of the spring 114 on the piston member 90 at any given position of the piston member 90 can be varied by turning the plug 84, and thus the exact left-to-right location of the extended position of the slave piston 62 can be precisely set as follows. The plug 84 is first tightened until the spring 114 is compressed and the second portion 96 of the piston member 90 abuts the wall 78. The threaded adjustment member 110 is then tightened until the flange portion 112 just closes the switch, i.e., until the switch member 134 just contacts the second terminal 132. The plug 84 is then backed out so that the spring 114 is less compressed, but so that the spring 114 is still compressed enough to keep the switch closed. Load is then applied to the polish rod 1, and the plug 84 is adjusted until the force of spring 114 is just high enough to retain the second portion 96 against the wall 78 at the minimum load and thereby cause the switch to be closed. Consequently, at this setting of the plug and the spring force the variations in the load will cause the switch to be repeatedly turned on and off. Thus, the extended position of the slave piston 62 is set during this final adjustment of the plug 84.

The ability to thus adjust the extended position of the slave piston 62 allows a user to set up the device such that the flange portion 112 of the threaded adjustment member 110 just closes the contact switch when the slave piston 62 is in the retracted position. The indicating device can therefore be set up such that the LED indicator 138 lights just once during each cycle of a reciprocatingly moving part such as a polish rod of a pump, and the indicating device is therefore able to produce an indication of the variation in the polish rod load. Adjustment of the point at which the contact switch is closed can also be accomplished by turning of the threaded adjustment washer 110 on the rod 92, which varies the distance between the piston member 90 and the flange portion 112.

The adjustment features of the present invention allow a single indicating device to be used with any of a wide range of wells, both deep and shallow, since the indicating device can be adjusted to indicate a wide variation of loads. The indicating device can also use the adjustment features to compensate for changes in elasticity of the spring 114, and small losses of fluid in the master and slave piston and cylinder arrangements. Accordingly, the adjustment features allow the indicating device of the present invention to be used for long periods of time without repair or replacement.

The indication of load variation in a reciprocally moving part such as a polish rod of a pump, which is provided by the indicating device of the present invention, is a simple and reliable indication which can readily be monitored by an operator who may not have a high level of technological expertise. For example, when the indicating device of the present invention is being used with pump which is experiencing a desired load variation, an operator will see a simple cyclical on/off pattern of flashing from the LED indicator of the indicating device. As long as the on/off pattern of flashing continues, and continues at the same frequency, the operator is given a good indication that the load is varying as desired. If the on/off pattern stops, i.e., if the indicator stays on or stays off, or if the frequency of flashing of the LED indicator changes, the operator knows that the pump has completely stopped operating, that the connection between the polish rod and the bridle has somehow failed, that a rod break has occurred and that the polish rod is no longer supporting a heavy weight, or that some other abnormal condition of the pump has occurred. With a little experience with the indicating device, an operator can quickly recognize the condition which a particular flashing pattern indicates. Thus, the indicating device of the present invention is extremely simple to monitor.

Additionally, since the indicating device is simple and rugged in construction, it is subject to only infrequent break downs, and, when it does break down, it is relatively simple to repair, since it contains no complex electronics.

It is to be appreciated that the advantages of the present invention can be obtained through the use of any of a number of fluids in the master and slave pistons and cylinders. For example, hydraulic fluid, oil, air, or other fluids may be used. Also, although the master and slave pistons and cylinders are shown in the drawings as being made of metal, they could also be advantageously made of any number of materials, such as plastic, ceramic, or combinations thereof. It is also to be understood that the indicating circuit arrangement may be mounted separately from the slave cylinder if desired, and that the slave piston and cylinder may be separate from the main piston and cylinder with, for example, a hose keeping the main and slave piston and cylinders in fluid communication.

Indicating circuit arrangements which are different from the one disclosed may be used, and advantages of the present invention obtained therefrom. For example, a circuit which includes a transistor may be used in the present invention, such that closing of the contact switch causes the transistor to cut the flow of current to the LED indicator, and therefore such that the LED indicator normally-provides a lighted indication, and is not lit only when the contact switch is closed. Also, the contact switch of the present invention may be replaced with another switch such as a magnetic switch, and the LED indicator may be replaced with another indicator such as a buzzer, a bell, or a whistle, and advantages obtained therefrom. The indicating circuit could also be completely replaced by a mechanical noisemaker which is activated once during each cycle of the slave piston. Also, the indicating circuit could be modified to allow graphic recording of the load variation on the polish rod, or to cause shut down of the power supply to the pump when the load variation becomes irregular.

At least some of the advantages of the present invention are also achievable if the slave piston and cylinder arrangement is arranged in fluid communication with the master piston and cylinder arrangement through a passageway through the master piston. Additionally, the slave piston may be held fixed to the master piston and cylinder arrangement, and the slave cylinder may be arranged movably, and some advantages obtained therefrom.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without deparrting from the spirit of the present invention. Accordingly, it is expressly intended that all such variations and changes which fall within the spirit and scope of the present invention as defined in the claims be embraced thereby.

What is claimed is:

1. (Thrice Amended) An apparatus comprising:

a reciprocally moving part driven by a reciprocal driving load, and an indicating device for indicating variations in the reciprocal driving load comprising:

reciprocating moving means operably connectible to said reciprocally moving part for reciprocally moving in response to the reciprocation of said reciprocally moving part and for acting on and pressurizing a fluid to a pressure in accordance with the driving load;

indicating means for providing an indication; and switch means for switching between an open state and a closed state, and for causing said indicating means to provide said indication when said witch means is in one of said open and closed states, said switch means being operably connected to said pressurized fluid to be switched thereby to said one of said open and closed states once during each cycle of said reciprocating movement of said reciprocating moving means.

2. An indicating device as claimed in claim 1, wherein said indicating means and said switch means are located in a circuit, said switch means causing current to flow through said circuit and activate said indicating means so that said indicating means produces said indication of reciprocating movement when said switch means is in said closed state.

3. An indicating device as claimed in claim 1, wherein said indicating means is an LED.

4. An indicating device as claimed in claim 1, further including adjustment means for adjusting said indicating device to allow said indicating device to provide indication over a wide range of loads.

5. An indicating device for indicating variations in a load on a reciprocally moving part, comprising:

reciprocating moving means for reciprocally moving in response to variations in the load;

indicating means for providing an indication; and switch means for switching between an open state and a closed state, and for causing said indicating means to provide said indication when said switch means is in one of said open and closed states, said reciprocating moving means causing said switch means to switch to said one of said open and closed states once during each cycle of said reciprocating movement of said reciprocating moving means;

wherein said reciprocating moving means includes a master piston and cylinder enclosing a fluid therebetween, and a slave piston and cylinder also enclosing a fluid therebetween which is in fluid communication with said fluid enclosed by said master piston and cylinder, a portion of one of aid slave piston and cylinder causing said switch means to switch to said one of said open and closed states once during each cycle of said reciprocating movement.

6. An indicating device as claimed in claim 5, wherein said master piston and cylinder are connectable to the part such that said master piston and cylinder move reciprocally with respect to each other to produce a cyclically varying pressure in said fluids enclosed by said master piston and cylinder and said slave piston and cylinder, said cyclically varying pressure causing said slave piston and cylinder to move reciprocally relative to each other such that said portion of said one of said slave piston and cylinder contacts and moves said switch means to said one of said open and closed states once during each cycle of said relative reciprocating movement of said slave piston and cylinder.

7. An indicating device as claimed in claim 5, wherein said slave piston is movable between a retracted position and a extended position, and is spring biased towards said retracted position.

8. An indicating device as claimed in claim 5, wherein said slave piston is movable between a retracted position and an extended position, and wherein said slave piston moves said switch means to said closed position when said slave piston is in said retracted position, to cause said indicating means to produce said indication of reciprocating movement.

9. An indicating device as claimed in claim 5, wherein said portion is a flange portion on said slave piston, wherein said switch means includes a contact switch which includes a switch member which is spring biased towards an open position, and wherein said flange portion contacts said switch member and closes it against said spring bias once during each cycle of reciprocating movement of said slave piston.

10. An indicating device as claimed in claim 5, wherein said master piston and cylinder are both toroidally-shaped and are placed around the part.

11. An indicating device for indicating variations in a load on a reciprocally moving part, comprising:

reciprocating moving means for reciprocally moving in response to the variations in the load;

indicating means for providing an indication; and switch means for switching between an open state and a closed state, and for causing said indicating means to provide said indication when said switch means is in one of said open and closed states, said reciprocating moving means causing said switch means to switch to said one of said open and closed states once during each cycle of said reciprocating movement of said reciprocating moving means;

wherein said reciprocating moving means includes a toroidally-shaped piston and cylinder arrangement.

12. An indicating device for indicating variations in a load on a reciprocally moving part, comprising:

reciprocating moving means for reciprocally moving in response to the variations in the load;

indicating means for providing an indication; and switch means for switching between an open state and a closed state, and for causing said indicating means to provide said indication when said switch means is in one of said open and closed states, said reciprocating moving means causing said switch means to switch to said one of said open and closed states once during each cycle of said reciprocating movement of said reciprocating moving means;

adjustment means for adjusting said indicating device to allow said indicating device to provide indication over a wide range of loads;

wherein said reciprocating moving means includes a slave piston and cylinder moving reciprocally with respect to each other, and said adjustment means includes a plug threaded into said slave cylinder and a spring extending between said plug and said slave piston, movement of said plug within said slave cylinder adjusting a stroke of said slave piston.

13. A polish rod load indicating device, comprising:

a master piston and cylinder enclosing a fluid therebetween, said master piston and cylinder being connectable to the polish rod such that one of said master piston and cylinder moves cyclically with respect to the other of said master piston and cylinder;

a slave piston and cylinder enclosing a fluid therebetween which is in communication with said fluid enclosed by said master piston and cylinder, said cyclical movement of said one of said master piston and cylinder producing a cyclically varying pressure in said fluids, said cyclically varying pressure causing one of said slave piston and cylinder to move cyclically relative to the other of said slave piston and cylinder;

an indicator; and a switch, said indicator producing a polish rod load indication signal in response to operation of said switch, said cyclically moving one of said slave piston and cylinder operating said switch to cause said indicator to produce said polish rod load indication signal once during each cycle of said cyclical movement of said cyclically moving one of said slave piston and cylinder.

14. A polish rod load indicating device as claimed in claim 13, wherein said slave cylinder is held fixed to said other of said master piston and cylinder, and said slave piston is movable relative to said slave cylinder such that said slave piston is said cyclically movable one of said slave piston and cylinder.

15. A polish rod load indicating device as claimed in claim 14, wherein said slave piston is movable between a retracted position and a extended position, and is spring biased towards said retracted position.

16. A polish rod load indicating device as claimed in claim 14, wherein said slave piston is movable between a retracted position and an extended position, and wherein said slave piston abuts said switch and thereby closes it when said slave piston is in said retracted position, to cause said indicator to produce said polish rod load indication signal.

17. A polish rod load indicating device as claimed in claim 13, wherein said indicator and said switch are located in a circuit, closing of said switch causing current to flow through said circuit and activate said indicator to produce said polish rod load indication signal.

18. A polish rod load indicating device as claimed in claim 13, wherein said indicator is an LED.

19. A polish rod load indicating device as claimed in claim 13, further comprising:

a flange portion on said cyclically moving one of said slave piston and cylinder, wherein said switch is a contact switch which includes a switch member which is spring biased towards an open position, and wherein said flange portion contacts said switch member and closes it against said spring bias once during each cycle of said cyclical movement.

20. A polish rod load indicating device as claimed in claim 13, wherein said master piston and cylinder are both toroidally-shaped and are placed around the polish rod.

21. A polish rod load indicating device as claimed in claim 13, further comprising:

a plug threaded into said slave cylinder; and a spring extending between said slave piston and said plug, movement of said plug with in said slave cylinder adjusting a stroke of said slave piston.

22. A polish rod load indicating device for indicating variation in a polish rod load, comprising:

a toroidally-shaped master piston;

a toroidally-shaped master cylinder cooperating with said master piston to enclose a fluid, said master piston and cylinder being connected to the polish rod;

a slave piston and cylinder enclosing a fluid which is in fluid communication with said fluid enclosed by said master piston and cylinder, said slave piston being movable between extended and retracted positions within said slave cylinder, said slave piston including a flange portion external to said slave cylinder, said slave piston being spring biased towards said retracted position;

a switch, said switch being movable between an open position and a closed position and being spring biased towards said open position; and an indicator, said indicator producing an indication when current flows therethrough, wherein said master piston is cyclically movable in response to cyclical movement of the polish rod to produce a cyclically varying pressure in said fluids, said cyclically varying pressure causing said slave piston to move cyclically between said extended and retracted positions such that said flange portion of said slave piston moves said switch to said closed position when said slave piston is in said retracted position, closing of said switch causing current to flow through said indicator so that said indicator provides said indication once during each cycle of said cyclical movement of said master piston to indicate variation in the polish rod load.

* * * * *